US005999073A

United States Patent [19]

Ricker et al.

[11] Patent Number: 5,999,073

[45] **Date of Patent: *Dec. 7, 1999**

[54] TRI-CORE, LOW RELUCTANCE TUBULAR SOLENOID

[75] Inventors: Russell Ricker, Chichester, N.H.; Clinton Sheppard, Mountain Home, Ark.

[73] Assignee: WPI Magnetic, Inc., Warner, N.H.

[ * ] Notice: This patent issued on a continued prosecution application filed under 37 CFR 1.53(d), and is subject to the twenty year patent term provisions of 35 U.S.C. 154(a)(2).

[21] Appl. No.: 08/748,286

[22] Filed: Nov. 13, 1996

Related U.S. Application Data

[60] Provisional application No. 60/015,541, Apr. 10, 1996.

[51] Int. Cl.[6] ..... H01F 7/00

[52] U.S. Cl. ..... 335/278; 335/281; 335/297; 336/216

[58] Field of Search ..... 335/255, 278, 335/202, 260, 281, 297; 174/35 MS; 220/4.21, 4.24, 4.25, 8, 682, 691; 336/83, 212, 216, 217

[56] References Cited

U.S. PATENT DOCUMENTS

| | | | |
|---|---|---|---|
| 128,003 | 6/1872 | Wiley | 220/4.21 |
| 933,307 | 9/1909 | Johnson | 220/4.21 |
| 1,051,183 | 1/1913 | Allen | 220/4.21 |
| 2,422,260 | 6/1947 | Ray | 335/256 |
| 2,484,248 | 10/1949 | Roehrl | 220/4.21 |
| 2,549,681 | 4/1951 | Goldstaub | 220/4.21 |
| 3,003,658 | 10/1961 | Lindsey | 220/4.21 |
| 3,484,015 | 12/1969 | Rowan | 220/4.21 |
| 4,025,887 | 5/1977 | Romans | 335/278 |
| 4,153,890 | 5/1979 | Coors | 335/260 |
| 4,267,539 | 5/1981 | Guinan | 335/42 |
| 4,272,654 | 6/1981 | Carlson | 179/119 A |
| 4,392,073 | 7/1983 | Rosenberry, Jr. | 310/216 |
| 4,438,418 | 3/1984 | Neff | 335/255 |
| 4,561,632 | 12/1985 | Hügler | 251/129.15 |
| 4,588,162 | 5/1986 | Moffat | 251/129.16 |
| 4,755,781 | 7/1988 | Bogner | 335/131 |
| 4,863,143 | 9/1989 | Cowley et al. | 251/129.15 |
| 5,233,304 | 8/1993 | Hubans | 324/323 |
| 5,387,892 | 2/1995 | Rossetti et al. | 335/254 |

FOREIGN PATENT DOCUMENTS

| | | | |
|---|---|---|---|
| 582145 | 9/1958 | Italy | 335/255 |

*Primary Examiner*—Michael L. Gellner
*Assistant Examiner*—Raymond Barrera
*Attorney, Agent, or Firm*—Bourque & Associates, P.A.

[57] ABSTRACT

A tri-core solenoid includes first, second and third core segments. The first and second core segments mate to form a low reluctance mating interconnect. The low reluctance mating interconnect includes, in one example, overlapping regions of the first and second core segments that form a joint surface area substantially in the same plane as the flow of flux through the first and second core segments. The third core segment, such as a plunger or armature, is slideably received in an aperture defined by the first and second core segments. The first core segment includes an end portion preferably having a first pole face that mates with a second pole face on the third core segment. The second core segment has a receiving region, such as a journal or bushing, that slideably receives the third core segment and forms a journal air gap therebetween.

13 Claims, 2 Drawing Sheets

TRI-CORE, LOW RELUCTANCE TUBULAR SOLENOID

RELATED APPLICATION

This application is a continuation of Provisional Patent Application Ser. No., 60/015,541 filed on Apr. 10, 1996.

FIELD OF THE INVENTION

The present invention relates to solenoids and in particular, to a low reluctance solenoid having three core segments.

BACKGROUND OF THE INVENTION

Conventional solenoids, such as those shown in prior art FIG. 1, have included a core design having four or more segments 12–18. One example of a prior art four segment solenoid core 10 includes a shell or frame 12, a bushing or journal 14, a plunger or armature 16, and a back stop or end cap 18. The four segment core design also includes at least two required air gaps 11,13. The working air gap 11 is located between the two magnetic pole faces forming the pole face geometry. The journal air gap 13 is located between the periphery of the plunger 16 and the bushing or journal 14.

During operation of the solenoid, magnetic flux 19(or magnetic lines of force) are transferred between the individual segments or core magnets, resulting in energy loss at the transfer points between segments. The transfer points include further unwanted air gaps at the interfaces 15, 17 between each of the multiple segments or pieces that are the equivalent of having resistors in series in an electrical circuit. Thus, conventional multiple segment solenoid cores often include several unwanted air gaps between each of the multiple segments 12–18 in addition to the required air gaps 11,13.

Accordingly, multiple segment solenoid cores are often not constructed for maximum efficiency. The increased efficiency of a solenoid is particularly important for applications in which solenoids are driven with low current electronics and/or with a battery as the supply voltage. Also, manufacturing costs increase with an increase in the number of segments or pieces that are required to make a tubular type solenoid. Accordingly, a tubular type solenoid is needed that lowers manufacturing costs while increasing the efficient conversion of electrical energy to mechanical work.

SUMMARY OF THE INVENTION

The present invention features a solenoid assembly comprising first, second and third core segments that are preferably substantially cylindrical in shape. The first c ore segment includes an end portion and the second core segment includes a receiving portion. The second core segment mates with the first core segment to form an aperture extending from the receiving portion to the end portion . The third core segment is slideably received in the aperture of the first core segment and second core segment.

The solenoid assembly includes a low reluctance mating interconnect between the first core segment and the second core segment. According to a preferred embodiment, the first core segment and second core segment include overlapping regions for mating the first core segment and the second core segment. The overlapping regions of the first core segment and second core segment preferably form a joint surface area between the overlapping regions that is substantially in the plane of the flow of flux through the first core segment and second core segment.

According to a preferred embodiment, the solenoid assembly further includes a coil disposed within the first core segment and second core segment and disposed substantially around the third core segment. One embodiment of the solenoid assembly includes a bobbin disposed within the first core segment and second core segment such that the coil is disposed around an outer surface of the bobbin and the bobbin is disposed around the third core segment.

The end portion of the first core segment preferably includes a first pole face substantially facing the aperture. The third core segment preferably includes a second pole face at one end of the third core segment adapted to mate with the first pole face. The first pole face and second pole face form a working air gape therebetween when the third core segment is slideably received in the aperture.

One example of the receiving portion includes a journal that forms a journal air gap with the third core segment when the third core segment is slideably received in the aperture. One example of the third core segment includes a plunger or armature.

The present invention also features a low reluctance solenoid core for use with a solenoid assembly. The low reluctance solenoid core comprises a first one-piece core segment including a first mating region and an end portion and a second one-piece core segment including a second mating region and a receiving portion. The first mating region and the second mating region overlap to form a low reluctance mating interconnect between the first one-piece core segment and the second one-piece core segment. The first and second one-piece core segments, when mated, form an aperture extending from the receiving portion to the end portion.

DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
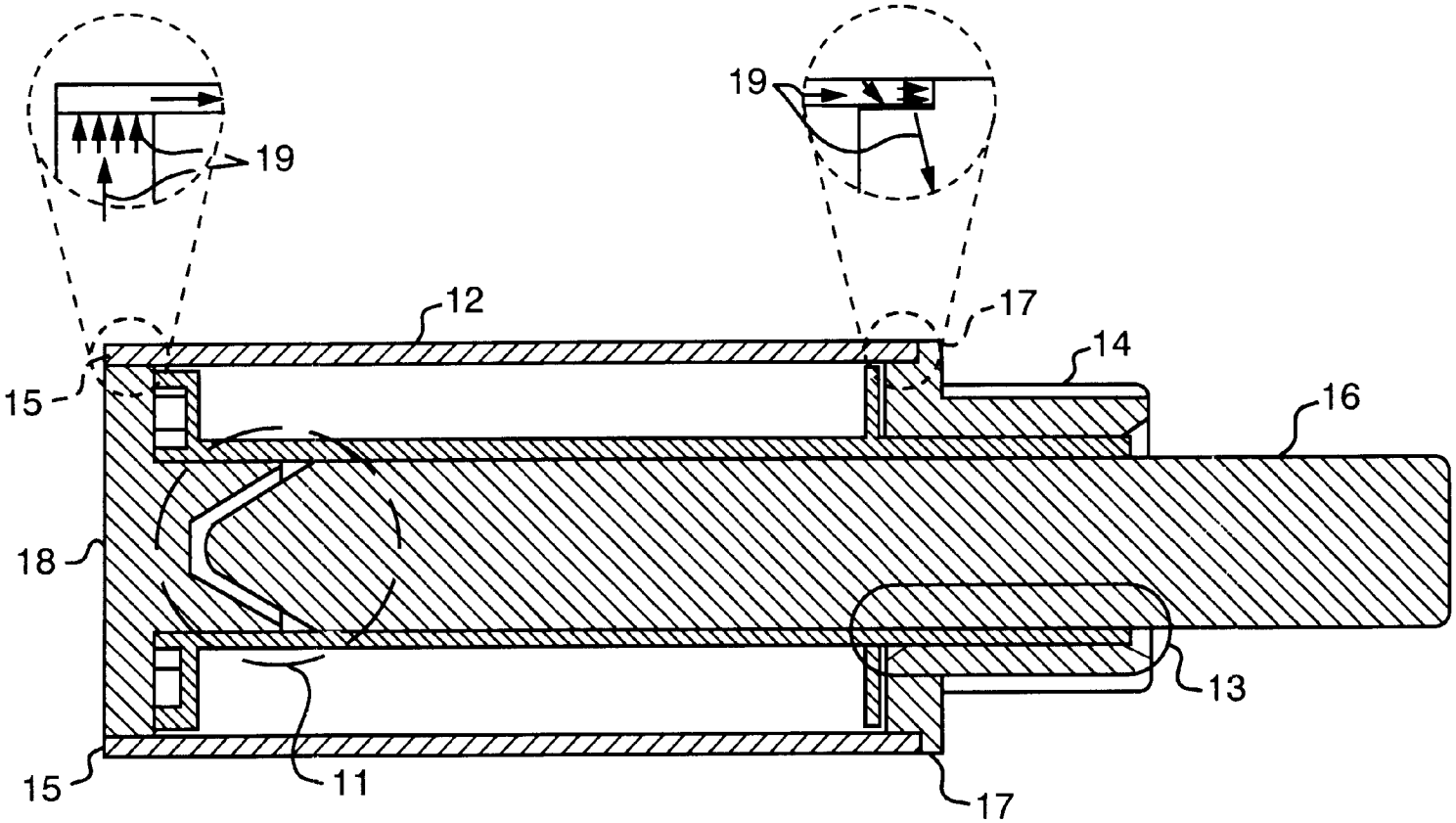
FIG. 1 (PRIOR ART)
FIG. 1 is a cross-sectional view of a prior art four segment solenoid core design.
Figure 2:
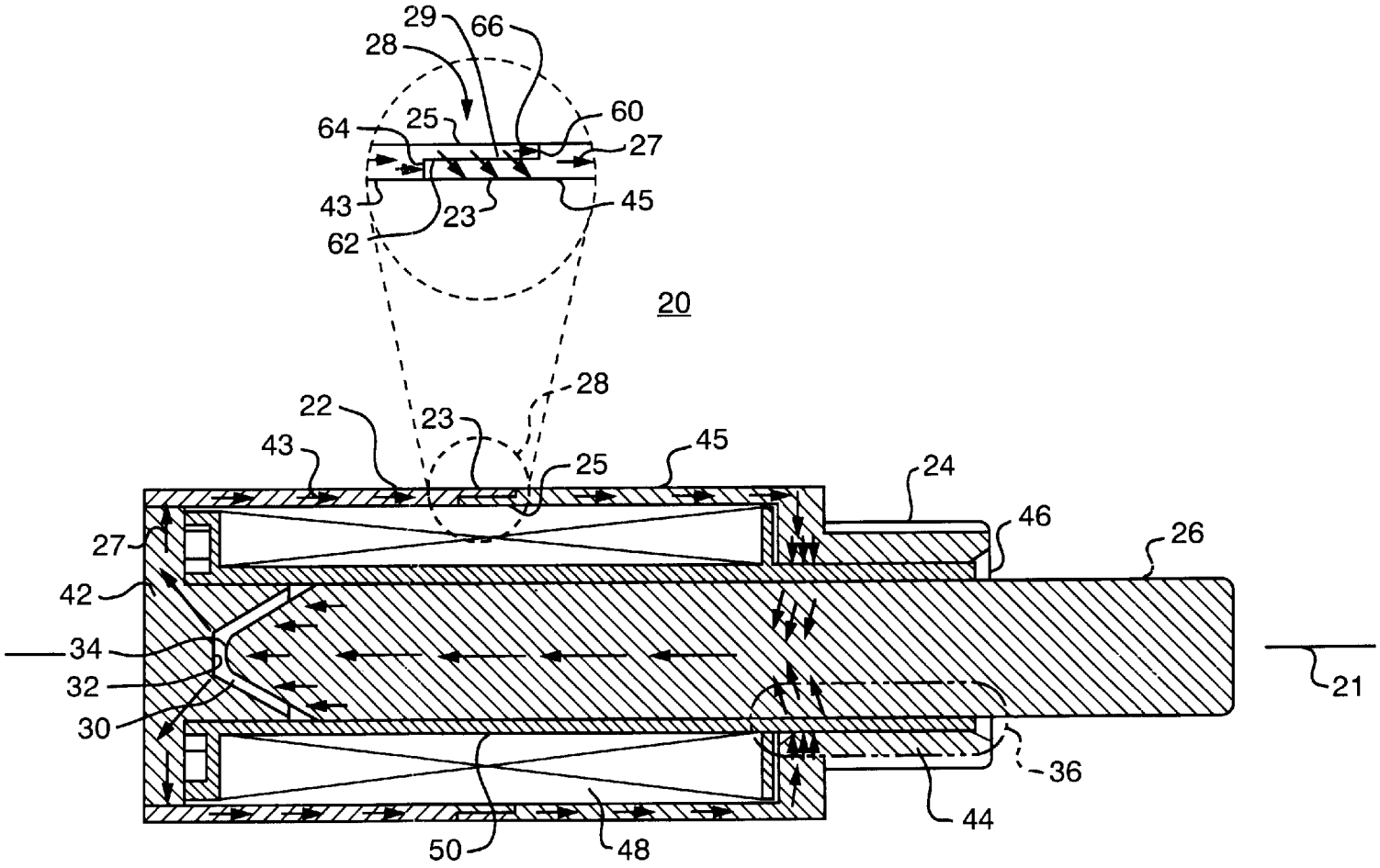
FIG. 2 is a cross-sectional view of a tri-core core solenoid design according to the present invention.

A tri-core solenoid 20, FIG. 2, according to the present invention, has a low reluctance magnetic core design developed for tubular solenoid applications. The low reluctance (i.e. high permeance, magnetic lines of flux flow more freely) is achieved through a novel, simplified and improved geometrical structure of the core and a novel geometrical design of the interface or interconnection between two segments of the core.

The tri-core solenoid 20 includes essentially three core segments 22, 24, 26. The first segment or rear core piece 22 fits together and mates with the second segment or front core piece 24 at a low reluctance mating interface or interconnection 28. The first core segment 22 includes a closed end portion 42 and a first shell portion 43 extending from the closed end portion 42 generally parallel to a longitudinal axis 21 of the solenoid 20. The second core segment 24 includes a plunger receiving portion 44, such as a journal or bushing, and a second shell portion 45 extending from the receiving portion 44 generally parallel to the longitudinal axis 21 of the solenoid 20. The first and second core segments 22, 24 define an aperture 46 extending from the plunger receiving portion to the end portion 42.

The third core segment is a plunger/armature 26 which is movably positioned within the aperture 46 formed by the mating rear core piece 22 and front core piece 24. By minimizing the number of segments that make up the core, the "transfer loss" is reduced because fewer unwanted flux transfer points or air gaps exist between the three segments 22, 24, 26 than in conventional 4 or 5 piece cores of the prior art.

The solenoid 20 further includes a coil or winding 48 disposed within the rear and front core pieces (or first and second core segments) 22, 24 and disposed substantially around the third core segment 26. In one example, the coil or winding 48 is disposed or wound around a bobbin 50, as known to those skilled in the art. The bobbin 50 is disposed within the rear and front core pieces 22, 24 and defines the aperture 46 that slideably receives the third core segment 26.

The existing required air gaps include the working air gap 30 between the two magnetic pole faces 32, 34 of the end portion 42 and the plunger/armature 26 respectively and the journal air gap 36 between the plunger or armature 26 and the front core piece 24 (also called the bushing or journal). The first pole face 32 and second pole face 34 form a pole face geometry shown as having generally the shape of a letter "V". The pole face geometry does not change the amount of power output but redistributes the power output over the distance the work is being performed. The present invention contemplates various pole face geometries defined by first and second pole faces 32, 34 of different shapes that will work effectively with the tri-core solenoid such as flat, various degree conical, cylindrical, stepped cylindrical, tapered, tapered-end, leakage flux, stepped conical and any of the above truncated.

By unifying the core and minimizing the number of core segments, most of the other unwanted transfer points or air gaps have been eliminated or reduced to thereby reduce the "transfer loss" and allow magnetic energy or lines of flux to flow more freely. The low reluctance mating interconnect 28 between the rear core piece 22 and the front core piece 24 presents the only other transfer point where loss could occur through an air gap or mating surface. The mating interconnection 28 between the rear core piece 22 and front core piece 24 has been designed with a geometry and increased surface area that provides better passage of lines of flux, resulting in a lower reluctance magnetic flux interconnect region. The low reluctance mating interconnect 28 is formed by overlapping or mating regions 23, 25 of the rear core piece 22 and front core piece 24 respectively.

The first mating region 25 has a first mating end 60 and a first mating recessed region 62. The second mating region 23 has a second mating end 64 and a second mating recessed region 66. The first mating end 60 engages the second mating recessed region 66 such that the first mating region 25 is substantially flush with the second shell portion 45, and the second mating end 64 engages the first mating recessed region 62 such that the second mating region 23 is substantially flush with the first shell portion 43. The first and second shell portions 43, 45 thus overlap to form the low reluctance mating interconnect 28 generally at an intermediate location between the closed end portion 42 and the receiving portion 44. A cross-section across the mating interconnect 28 and at least part of the first and second shell portions 43, 45 adjacent the mating interconnect 28 has a substantially uniform thickness.

The overlapping regions 23, 25 of the low reluctance mating interconnect 28 provide a substantial portion of joint surface area 29, in substantially the same plane as the flow of flux 27. Also, the surface area 29 of the overlapping regions 23, 25 is substantially increased to allow more free flowing of flux through the joint or interconnect 28. Although the overlapping regions 23, 25 are shown having stepped configuration, the present invention contemplates rounded or angled overlapping regions to increase flux transfer.

Unifying the core allows the transfer points or air gaps 15, 17 in the conventional four segment core 10 to be replaced with the single low reluctance mating interconnect 28, resulting in less power loss in the magnetic core structure and improving the conversion of electrical energy to work.

Accordingly, the tri-core solenoid according to the present invention provides a low reluctance mating interconnect and reduces the number of unnecessary fixed air gaps, thereby increasing the efficiency of the solenoid. The tri-core solenoid of the present invention also reduces manufacturing costs by reducing the number of required core segments.

Modifications and substitutions by one of ordinary skill in the art are considered to be within the scope of the present invention which is not to be limited except by the claims which follow.

What is claimed is:

1. A low reluctance solenoid core for use with a solenoid assembly, said low reluctance solenoid core comprising:

a first one-piece solenoid core segment forming an end portion and a first shell portion extending from said end portion generally parallel to a longitudinal axis of said low reluctance solenoid core, said first shell portion having a first mating region with a first mating end and first mating recessed region, said first mating recessed region extending circumferentially completely around said first one-piece solenoid core segment;

a second one-piece solenoid core segment forming a receiving portion and a second shell portion extending from said receiving portion generally parallel to said longitudinal axis of said low reluctance solenoid core, said second shell portion having a second mating region with a second mating end and second mating recessed region, said second mating recessed region extending circumferentially completely around said second one-piece solenoid core segment;

wherein said first mating region of said first one-piece solenoid core segment and said second mating region of said second one-piece solenoid core segment overlap such that said first mating end engages said second mating recessed region and said second mating end engages said first mating recessed region to form a low reluctance mating interconnect between said first one-piece solenoid core segment and said second one-piece solenoid core segment, wherein a cross-section of said solenoid core across at least part of said first and second shell portions and said low reluctance mating interconnect has a uniform thickness, wherein a flow of magnetic flux before and after said low reluctance mating interconnect is substantially in a same direction, and wherein said first one-piece solenoid core segment and said second one-piece solenoid core segment form an aperture extending from said receiving portion to said end portion; and a third solenoid core segment slidably received within said receiving portion of said second one-piece solenoid core segment and into said first one-piece solenoid core segment.

2. The low reluctance solenoid core of claim 1, wherein said first mating region and said second mating region overlap to form a joint surface area substantially in a plane of a flow of flux through said first one-piece core segment and said second one-piece core segment.

3. The low reluctance solenoid core of claim 1, wherein said receiving portion includes at least one of a journal and a bushing.

4. The low reluctance solenoid core of claim 1, wherein said end portion includes a pole face adapted to mate with an end of at least one of a plunger and an armature.

5. The low reluctance solenoid core of claim 1 wherein said first shell portion of said first one-piece core segment has a cylindrical shape, wherein said second shell portion of said second one-piece core segment has a cylindrical shape.

6. The low reluctance solenoid core of claim 1 wherein said first and second mating regions overlap to form a joint surface area substantially in a plane of said flow of magnetic flux.

7. The low reluctance solenoid core of claim 1 wherein said first and second mating regions have an overlapping stepped configuration.

8. The low reluctance solenoid core of claim 1 wherein said low reluctance mating interconnect is disposed at an intermediate location between said closed end portion and said receiving portion.

9. A low reluctance solenoid core for use with a solenoid assembly, said solenoid core comprising:

a first one-piece solenoid core segment forming a closed end portion and a first shell portion extending from said closed end portion at an angle with respect to said closed end portion, said first shell portion having a first mating region with a first mating end and a first mating recessed region;

a second one-piece solenoid core segment forming a receiving portion and a second shell portion extending from said receiving portion, said second shell portion having a second mating region with a second mating end and second mating recessed region;

wherein said first mating end of said first mating region engages said second mating recessed region of said second mating region such that said first mating region is substantially flush with said second shell portion, wherein said second mating end of said second mating region engages said first mating recessed region of said first mating region such that said second mating region is flush with said first shell portion, wherein said first and second mating regions of respective said first and second shell portions overlap to form a mating interconnect at an intermediate location between said closed end portion and said receiving portion, and wherein said first one-piece solenoid core segment and said second one-piece solenoid core segment form an aperture extending from said receiving portion to said closed end portion and enclosed by said first and second shell portions; and a third solenoid core segment slidably received within said receiving portion of said second one-piece solenoid core segment and into said first one-piece solenoid core segment.

10. The low reluctance solenoid core of claim 9, wherein a cross-section across said mating interconnect and at least part of said first and second shell portions adjacent said mating interconnect has a uniform thickness.

11. The low reluctance solenoid core of claim 10 wherein said first mating region of said first shell portion and said second mating region of said second shell portion form a joint surface area parallel to said longitudinal axis of said solenoid core.

12. The low reluctance solenoid core of claim 11 wherein said first and second mating ends of said first and second mating regions are orthogonal to said joint surface formed between said first and second mating regions, forming a stepped configuration.

13. The low reluctance solenoid core of claim 12 wherein said first shell portion and said second shell portion have a cylindrical shape.

* * * * *